United States Patent [19]

Brown et al.

[11] Patent Number: 4,621,560

[45] Date of Patent: Nov. 11, 1986

[54] METHOD OF SEQUENCED BRAIDER MOTION FOR MULTI-PLY BRAIDING APPARATUS

[75] Inventors: Richard T. Brown, Woodbridge, Va.; Eric D. Ratliff, Washington, D.C.

[73] Assignee: Atlantic Research Corporation, Alexandria, Va.

[21] Appl. No.: 722,064

[22] Filed: Apr. 11, 1985

[51] Int. Cl.[4] ..... D04C 1/00; D04C 3/00

[52] U.S. Cl. ..... 87/8; 87/33; 139/11

[58] Field of Search ..... 27/8, 33, 34, 37, 53; 139/11, 13 R, 16

[56] References Cited

U.S. PATENT DOCUMENTS 2,412,353 12/1946 Parker ..... 139/11 X
3,059,668 10/1962 Greenspan ..... 139/11 X
3,426,804 2/1969 Black ..... 87/33 X
4,312,261 1/1982 Florentine ..... 87/37 X

FOREIGN PATENT DOCUMENTS 2301696 7/1973 Fed. Rep. of Germany ..... 87/33

*Primary Examiner*—John Petrakes
*Attorney, Agent, or Firm*—Quaintance, Murphy & Presta

[57] ABSTRACT

A braiding method wherein fiber carriers are arranged in rows and columns which are moved in a predetermined alternating sequence to intertwine the fibers and form a braided article. A selected intermediate row is moved a distance sufficient to block movement of a column on one side thereof. While the column is blocked, a tamping force is applied thereto to move it against the one side of the selected row to facilitate proper alignment of the fiber carriers in the column.

5 Claims, 6 Drawing Figures

FIG. 1
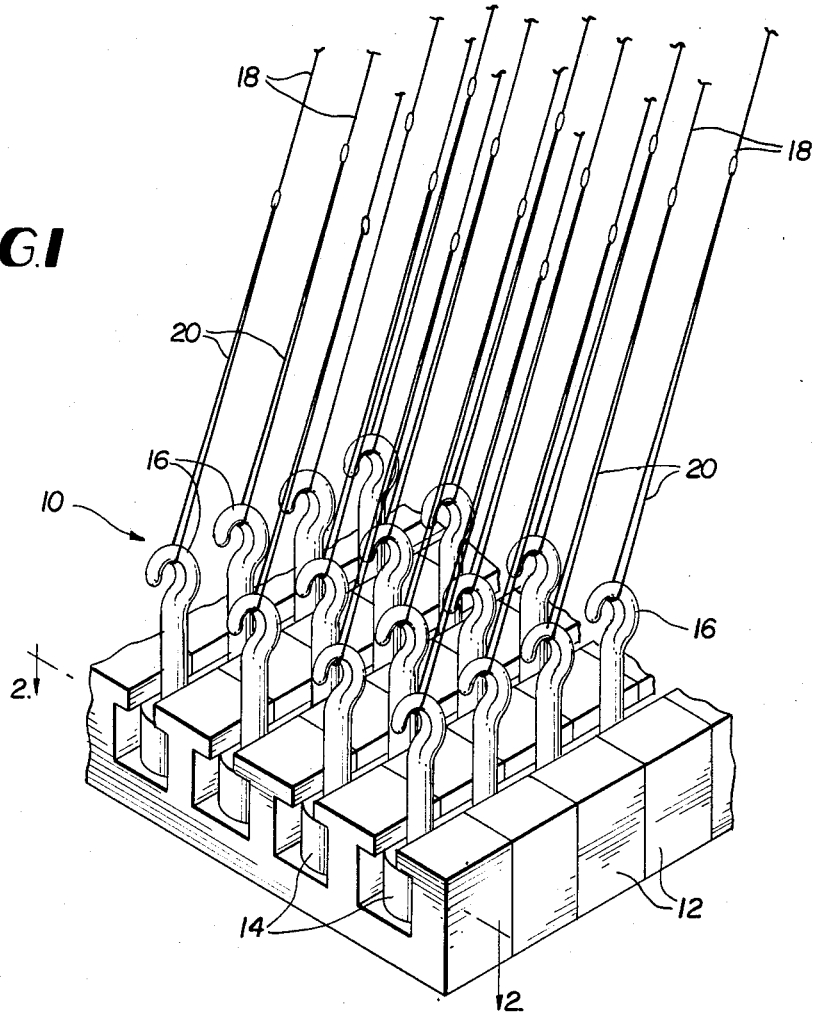
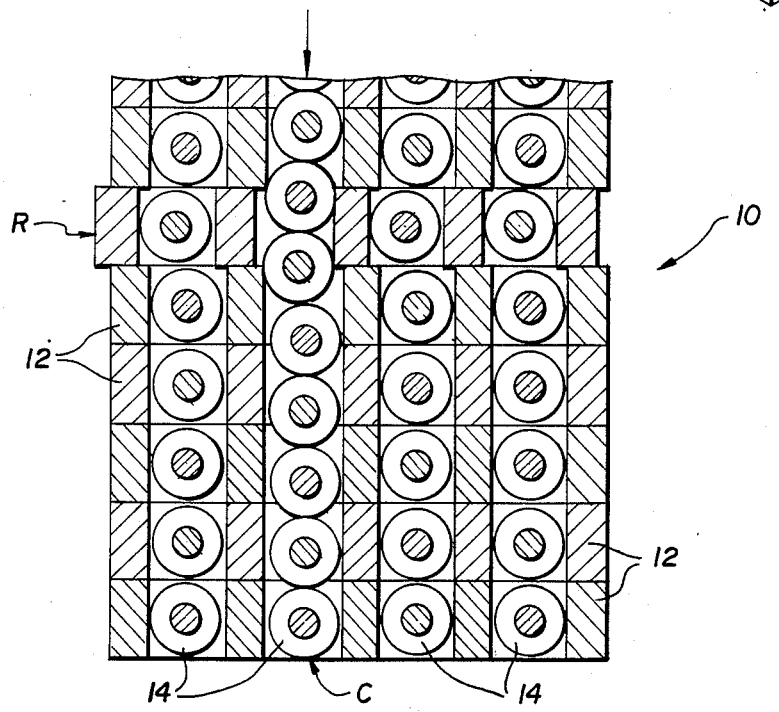
FIG. 2

METHOD OF SEQUENCED BRAIDER MOTION FOR MULTI-PLY BRAIDING APPARATUS

BACKGROUND OF THE INVENTION

This invention relates to multi-ply braiding machines and, more particularly, to such machines wherein sequenced row and column motion is utilized to eliminate fiber carrier jamming due to tolerance stackups.

The process of braiding is distinguished from weaving in that all fibers are interchanged (moved) in a braiding cycle while in weaving only a single fiber (the fill) is moved through a fixed array of fibers (the warp). Multi-ply braiding is distinguished from conventional braiding in that more than two layers (plys) are formed by the process.

Any braiding process is then characterized by the fact of all fiber carriers being in motion resulting in intertwined fibers. Multi-ply braiding machines use a matrix array of carriers capable of alternate row and column position shifts. Reversal of the direction of row and column motion during a complete shift cycle produces the intertwining of fibers. Production of complex shapes is possible by adjusting the length of travel (number of spaces shifted) of each row or column.

Multi-ply braiding concepts and machines are disclosed in the patents to Bluck No. 3,426,804 and Florentine No. 4,312,261. In the Bluck and Florentine patents, the teachings of which are incorporated herein by reference, each row and column consists of discrete eyelets or carrier blocks. In other machines presently in use, row motion is accomplished by shifting grooved track members containing fiber carriers. Column motion consists of shifting the discrete fiber carriers. In circular concepts, row motion is accomplished by shifting concentric rings or track members. Column (radial) motion again consists of shifting discrete carriers. The present invention pertains to all of the above-mentioned methods (discrete blocks, tracks or rings) as well as other presently known methods of shifting fiber carriers. In the present application, reference to rows and columns are intended to cover braiding concepts wherein the rows and columns are disposed in perpendicular relation, as shown in the drawings, as well as circular arrangements wherein the rows are disposed in concentric relation and the columns are radially disposed.

In all of the braiding concepts considered, row and column motion is accomplished by mechanical, electrical or pneumatic actuators mounted about the perimeter of the apparatus. Accordingly, the motion of an interior fiber carrier is caused by the push from an adjacent carrier or by a shifting of the track beneath. Any misalignment (failure to complete a full shift motion) will prohibit shifting of the perpendicular or transverse rows or columns. Therefore, a failure of any of the large array of moving carriers to achieve a precise position will jam the machine. In an apparatus of practical size this will happen frequently due to the odds of an unfavorable tolerance stack up. The scale of multi-ply braiding equipment is limited, therefore, by the dimensional uniformity which can be achieved in the manufacture of fiber carriers.

In the discrete block or eyelet patents to Bluck and Florentine, this unfavorable stack up can occur in both the row and column directions, although it is most likely to occur in the direction containing the most carriers (long side of the array). An unfavorable stack up will be a random event which occurs when a given row or column contains sufficient undersize or oversize carriers. In the grooved track (or ring) concept an unfavorable stack up is only caused by column (radial) motion and will happen with each column shift. This is because a small gap between tracks (rings) exists and the take up of the accumulated gap when each carrier makes contact and pushes the adjacent carrier results in a misalignment of the carriers nearest the pushing actuator.

The present invention provides the following advantages over presently known braiding concepts and machines:

(1) Eliminates machine jamming;

(2) Permits unjammed operation of multi-ply braiding machines having any number of fiber carriers; and (3) Permits utilization of lower cost, low tolerance multi-ply braiding machines.

SUMMARY OF THE INVENTION

In the method of the present invention, sequenced motion of rows or columns is utilized rather than simultaneous motion. The new and improved method of this invention is implemented by the following devices:

(1) A tamping stroke by one set of actuators.

(2) A fractional unit stop in the sliding motion perpendicular to the tamping motion.

(3) A sequence controller. For purposes of explanation, a grooved track braiding machine will be considered. A braiding cycle of the present invention is performed as follows:

(1) Columns of fiber carriers are shifted simultaneously in opposing motion. On one side of the column motion, the stopping position is fixed by pins or the like in the actuator shaft. On the opposite side, force is applied sufficient to shift alternate columns of carriers.

(2) On the side opposite the fixed position, a tamping force is briefly applied by all actuators sufficient to take up all gaps and to compact the carriers against the fixed side. The maximum out of tolerance condition now exists adjacent to the tamping actuators.

(3) An actuator device, through a linkage, moves a series of fractional unit stop cams which permit additional movement of predetermined, spaced track members such as, e.g., every eighth track member. Track member movement has not yet occurred.

(4) Starting at the fixed side, the rows of track members are then shifted in opposing directions by the controller.

(5) When the eighth track member is actuated, it moves an extra distance as permitted by the fractional unit stop cam. This extra motion locks out the first segment of the braiding array. The new column fixed position is now at the eighth track.

(6) The tamping force can then be applied briefly (if necessary) to compact the moving column of carriers against the side of the eighth track member.

(7) The sequence of track member (row) shifts is then continued in sets of every eight track members working toward the tamping actuators.

(8) Once all track members are shifted, the fractional unit stop cams are actuated to complete the motion of the affected track members.

The above-mentioned cycle is repeated continuously during the braiding process to form the braided product.

BRIEF DESCRIPTION OF THE DRAWINGS

FIG. 1 is a perspective view of a portion of a braiding apparatus of the type to be used in connection with the method of the present invention;

FIG. 2 is a sectional view taken substantially along line 2—2 in FIG. 1;

DESCRIPTION OF THE PREFERRED EMBODIMENT

Figure 3:
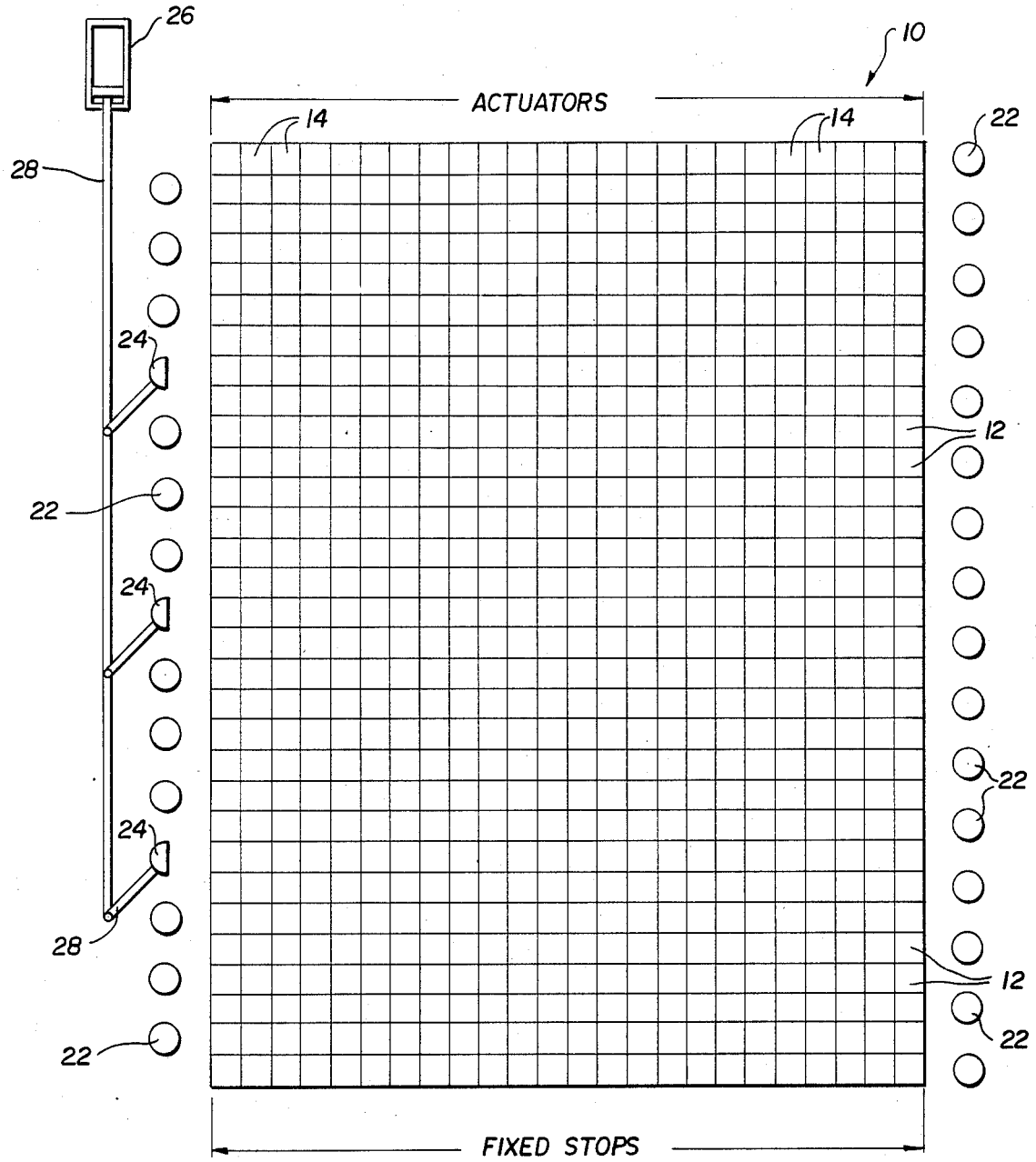
FIG. 3 is a diagrammatic plan view of the braiding apparatus of FIGS. 1 and 2, showing the apparatus in a starting position.

As hereinbefore described, the method of the present invention can be used in connection with different types of braiding apparatus such as the braiding apparatus 10 shown in FIG. 1 which generally comprises a plurality of rows formed by grooved track members 12 /and a plurality of columns formed by a plurality of fiber carriers 14 that are slidably mounted within the grooved track members 12. Each of the fiber carriers 14 is provided with an upper hook portion 16 to which the fibers 18 are connected by elastic members 20 or the like. In accordance with known techniques, predetermined alternate movement of the rows (track members 12) and the columns (fiber carriers 14) produces the intertwining of the fibers 18 to form a braided article of a desired size and shape. The row and column motion can be effected by any suitable means (not shown), such as mechanical, electrical or pneumatic actuators mounted about the periphery of the braiding apparatus 10.

Referring to FIG. 2, because of the lack of dimensional uniformity of some or all of the fiber carriers 14, some of them will not move to the proper position when the column is moved by an actuator to thereby block movement of one or more of the rows or track members 12 and thus jam the braiding apparatus. In FIG. 2, it will be seen that many of the fiber carriers 14 in the column C are in an improper position after downward movement of the column C against a fixed stop (not shown) to thereby block lateral movement of some of the rows or track members, such as the row R. Thus, the braiding apparatus 10 is jammed and cannot continue to operate until the carriers 14 in the column C are properly positioned.

FIGS. 3 through 6 illustrate in diagrammatic form the braiding apparatus 10 as modified in accordance with the method of the present invention. Actuators (not shown) are provided to move the columns of fiber carriers 12 vertically against fixed stops (not shown), and other actuators (not shown) are provided to move the rows of track members 12 laterally in an alternating sequence against stops 22 located on both sides of the rows. The stops 22 may be of any suitable or desired construction.

As shown in FIGS. 3 through 6, movable stop cams 24 are positioned between the stop members 22 at predetermined intervals, such as every eighth row, on one side of the rows of track members 12. Preferably, each stop cam 24 is rotatable and is of a size and shape such that, in a first position, it will allow the adjacent row or track member 12 to move laterally into contact therewith a distance greater than the rows or track members contacting the fixed stop members 22 and, in a second position, will stop or move the adjacent row or track member to the same lateral position as the rows in contact with the stop members 22 on the same side of the braiding apparatus. An actuating means 26 of any suitable construction is connected to the stop cams 24 by a linkage 28 for the purpose of selectively moving the stop cams 24 between the first and second positions.

In the practice of the method of the present invention, as shown in FIGS. 3 through 6, the stop cams 24 are initially moved to the first position by the actuator 26 at the beginning of a row motion sequence as specifically illustrated in FIG. 3. Thereafter, in accordance with the braiding process, rows of track members 12 are shifted in opposing directions in sequence by the actuating means (not shown) of the braiding apparatus.

Figure 4:
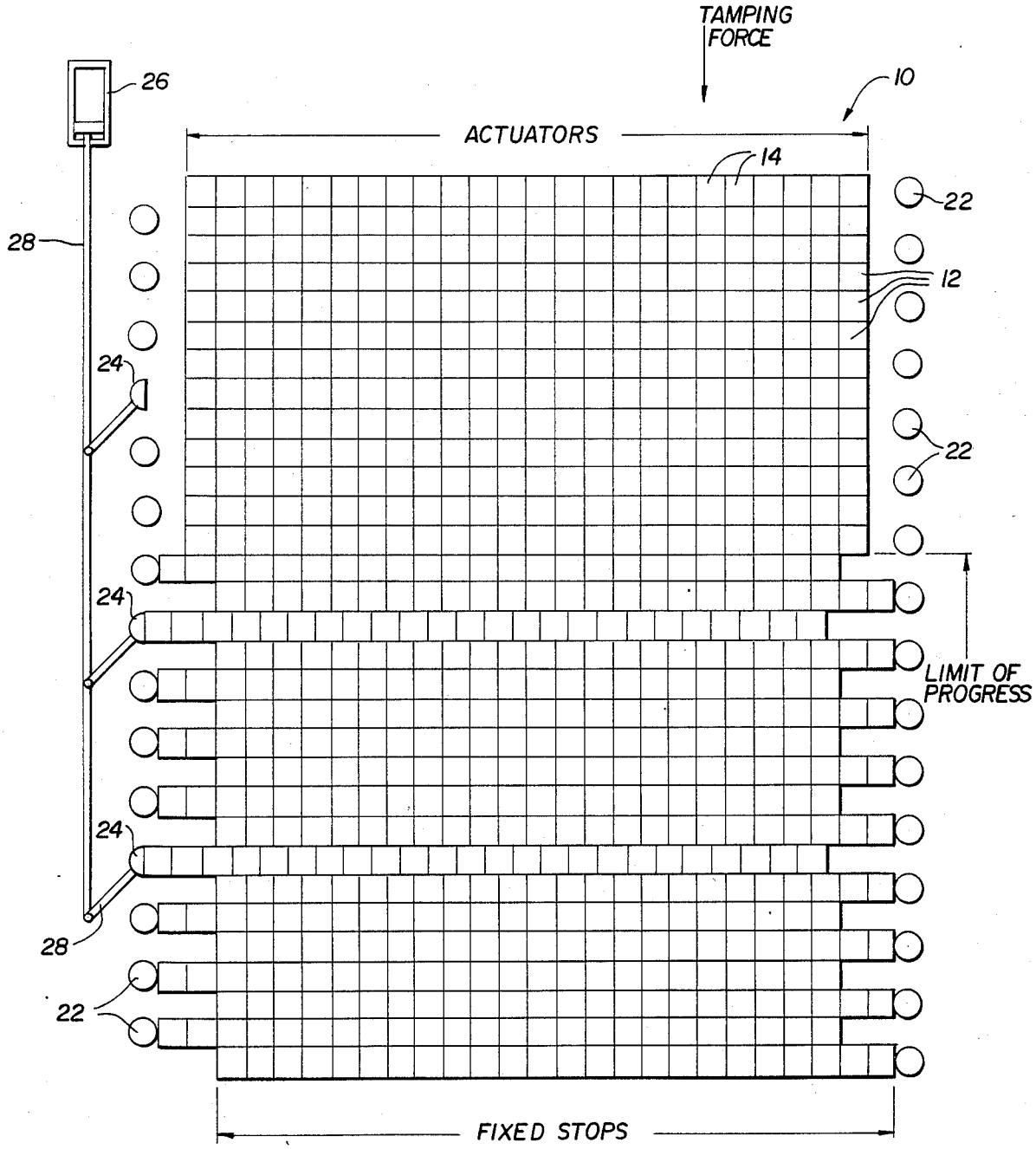
FIG. 4 is a diagrammatic plan view similar to FIG. 3, showing the braiding apparatus with the row or track member motion in progress in accordance with the method of the present invention.

In referring to FIG. 4, the braiding apparatus is shown in a condition wherein row or track member motion is in progress from one end of the braiding apparatus to the other (or from the bottom towards the top as shown in FIG. 4). Because of the position of the stop cams 24, it will be understood that every eighth row or track member being moved into engagement with a stop cam will move farther than the adjacent rows engaging the fixed stop members 22. As each eighth row or track member is moved into engagement with a stop cam 24, a tamping force is applied by the actuators (not shown) of any suitable type in a downward direction as shown in FIG. 4 to press the moving columns of fiber carriers 14 against the upper surface of the eighth row or track member 12. The extra lateral movement of the eighth row or track member into engagement with the stop cam 24 serves to lock out the first segment of the braiding array located beneath the eighth row or track member, and the tamping force of the columns against the eighth row or track member serves to position a shorter column of carriers 14 against the eighth row or track member 12 to thereby minimize misalignment of the fiber carriers owing to a lack of dimensional uniformity thereof and effectively prevent jamming of the braiding apparatus.

As each eighth row or track member 12 is moved sequentially into engagement with a stop cam 24, the tamping force is applied so as to press a sequentially shorter column of fiber carriers 14 against each eighth row or track member as the sequential movement of the rows or track members is effected from one end of the braiding apparatus to the other (or from the bottom to the top of the braiding apparatus as shown in FIGS. 3 through 6). FIG. 4 illustrates the braiding apparatus after the eighth and sixteenth rows or track members 12 have been moved into engagement with the adjacent stop cams 24 and the tamping force applied to the columns of carriers 14 above these rows or track members after they have been sequentially moved into engagement with the stop cams 24.

Figure 5:
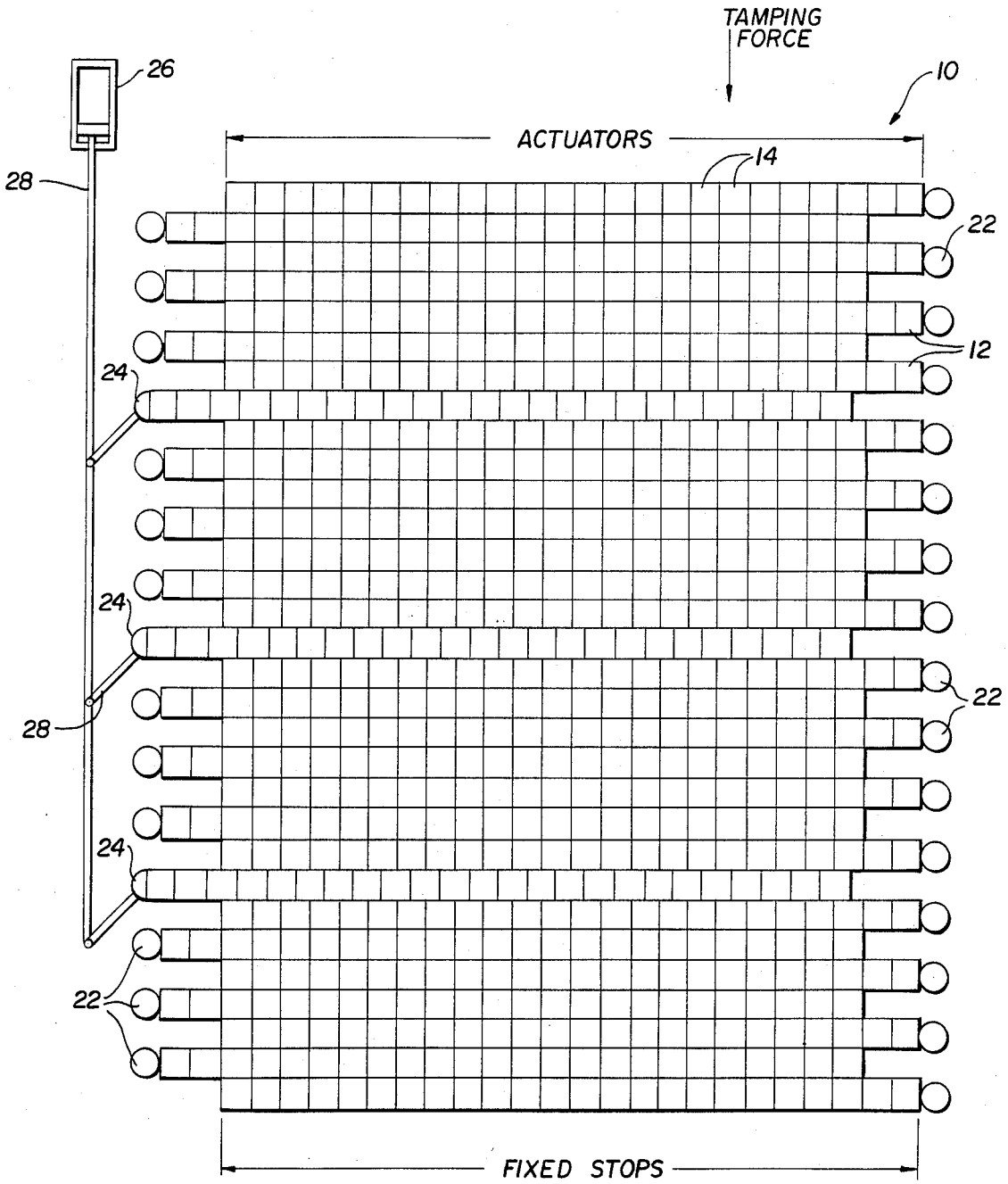
FIG. 5 is a diagrammatic plan view similar to FIGS. 3 and 4, showing the row or track member motion complete except for the rows or track members in engagement with the stop cams, in accordance with the method of the present invention.

FIG. 5 illustrates the condition of the braiding apparatus 10 after a row or track member motion sequence has been completed from the bottom to the top thereof. In this condition, it will be seen that every eighth row or track member 12 has been moved into engagement with an adjacent stop cam 24 and the tamping force has been applied to the columns of carriers 14 as each eighth row or track member has been sequentially moved into engagement with the adjacent stop cams 24.

Figure 6:
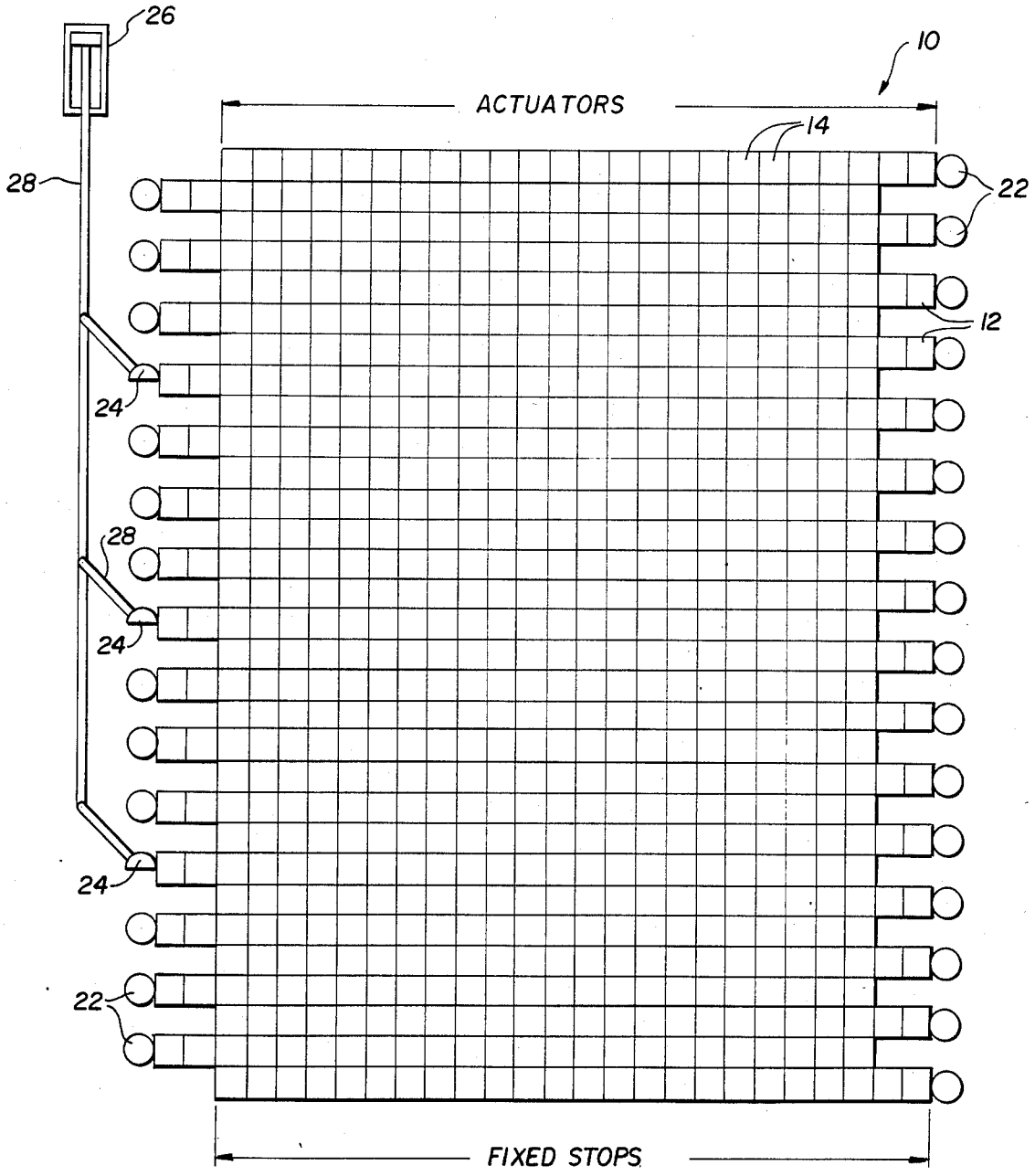
FIG. 6 is a diagrammatic plan view similar to FIGS. 3, 4 and 5, showing the row or track member motion sequence completed, including the rows or track members engaging the stop cams, in accordance with the method of the present invention.

In order to continue the operation of the braiding apparatus 10 after the completion of the row or track member motion sequence, the actuator 26, through the linkage 28, moves the stop cams 24 to the second position shown in FIG. 6, wherein the stop cams move the adjacent rows or track members 12 into alignment with the other rows or track members in engagement with the stop members 22 on the same side of the braiding apparatus as the stop cams 24. Thereafter, the stop cams 24 are again moved by the actuator 26 and linkage 28 to the first position shown in FIG. 3 to begin another cycle of row or track member motion sequence as shown in FIGS. 3 through 6. This cycle is repeated continuously during the braiding process to form the braided product.

From the foregoing description, it will be readily seen that the new and improved method of the present invention serves to prevent jamming of braiding apparatus, such as the braiding apparatus 10 shown in FIGS. 1 and 2, in a simple and efficient manner without interrupting the braiding process to any significant extent. The stop cams 24 can be spaced any suitable number of rows apart, depending on the extent of nonuniformity of size of the fiber carriers and/or spacing between track members, and the tamping interval necessary to insure against jamming of the braiding apparatus.

What is claimed is:

1. In a braiding method wherein fiber carriers are arranged in rows and columns which are moved in a predetermined alternating sequence to intertwine the fibers and form a braided article, the improvement comprising the steps of:

moving a selected intermediate row a distance sufficient to block movement of a column on one side thereof, and applying a tamping force to said column to move it against said one side of said selected row while it is blocking movement of said column, whereby said column is temporarily shortened to facilitate proper alignment of the fiber carriers therein.

2. The braiding method of claim 1 comprising the further step of moving said selected row to a position wherein it does not block movement of said column after the tamping force has been applied thereto.

3. The braiding method of claim 2 wherein movable stop cams are utilized to control the movement of said selected intermediate rows.

4. The braiding method of claim 1 wherein selected intermediate rows are sequentially moved a distance sufficient to block movement of columns on one side thereof, and a tamping force is sequentially applied to said columns to move them against said one side of each of said selected rows as they are moved to said blocking position.

5. The braiding method of claim 4 wherein said selected intermediate rows are substantially uniformly spaced.

* * * * *